US006581574B1

(12) United States Patent
Moran et al.

(10) Patent No.: US 6,581,574 B1
(45) Date of Patent: Jun. 24, 2003

(54) METHOD FOR CONTROLLING FUEL RAIL PRESSURE

(75) Inventors: Kevin David Moran, Trenton, MI (US); Guoming George Zhu, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/108,093

(22) Filed: Mar. 27, 2002

(51) Int. Cl.[7] ..... F02M 37/04
(52) U.S. Cl. ..... 123/497; 123/494
(58) Field of Search ..... 123/497, 357, 123/456, 494; 417/53

(56) References Cited

U.S. PATENT DOCUMENTS 5,237,975 A * 8/1993 Betki et al. ..... 123/497
5,579,738 A * 12/1996 Frischmuth et al. ..... 123/497
5,819,709 A * 10/1998 Holmes et al. ..... 123/497
6,223,731 B1 * 5/2001 Yoshiume et al. ..... 123/497
6,293,757 B1 * 9/2001 Oda et al. ..... 417/53
6,349,700 B1 * 2/2002 Buckland et al. ..... 123/352

* cited by examiner

*Primary Examiner*—Carl S. Miller
(74) *Attorney, Agent, or Firm*—Brinks Hofer Gilson & Lione

(57) ABSTRACT

A method of controlling the fuel pressure within a fuel delivery system having a fuel pump that delivers fuel to a fuel rail of an internal combustion engine includes providing a set-point fuel pressure, generating a feed forward signal having a set of fuel pump motor control parameters based upon the set-point fuel pressure and the desired fuel flow rate, providing a pressure sensor to measure the fuel rail pressure, comparing the fuel rail pressure to the set-point fuel pressure and generating an error value based upon the difference between the fuel rail pressure and the set-point fuel pressure, providing a feed back controller adapted to receive the error value and to generate a feed back control signal, combining the feedback control signal and the feed forward control signal to generate a motor controller signal.

18 Claims, 3 Drawing Sheets

METHOD FOR CONTROLLING FUEL RAIL PRESSURE

TECHNICAL FIELD

The present invention generally relates a method of controlling the fuel pressure within the fuel rail of an internal combustion engine.

BACKGROUND

Within an internal combustion engine fuel delivery system, a fuel rail delivers fuel to fuel injectors that inject the fuel into the cylinders of the engine. The pressure of the fuel being injected through the fuel injectors is critical, therefore it is important to keep the pressure within the fuel rail as consistent as possible. Closed loop control systems for controlling the fuel pressure within fuel rails have been developed, but do not adapt to system variations such as part-to-part tolerance differences and wear. Therefore, there is a need for an improved method of controlling the fuel pressure within the fuel rail of an internal combustion engine.

DETAILED DESCRIPTION OF THE PREFERRED EMBODIMENTS

The following description of the preferred embodiments of the invention is not intended to limit the scope of the invention to these preferred embodiments, but rather to enable any person skilled in the art to make and use the invention.

Figure 1:
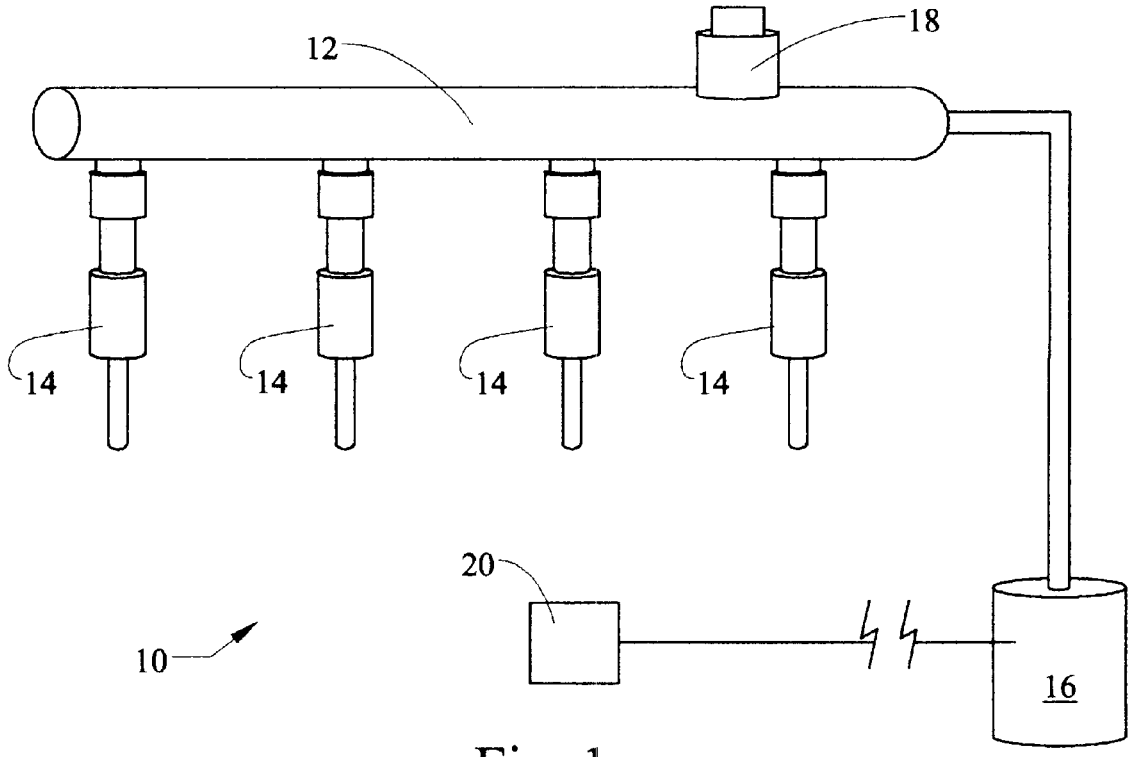
FIG. 1 is a schematic view of a first preferred embodiment of a fuel rail delivery system of the present invention.

Referring to FIG. 1, a fuel delivery system 10 of the present invention includes a fuel rail 12 adapted to deliver fuel to fuel injectors 14 of an internal combustion engine, a fuel pump 16 adapted to deliver fuel to the fuel rail 12, a fuel pressure sensor 18, and a fuel pump motor controller 20.

Figure 3:
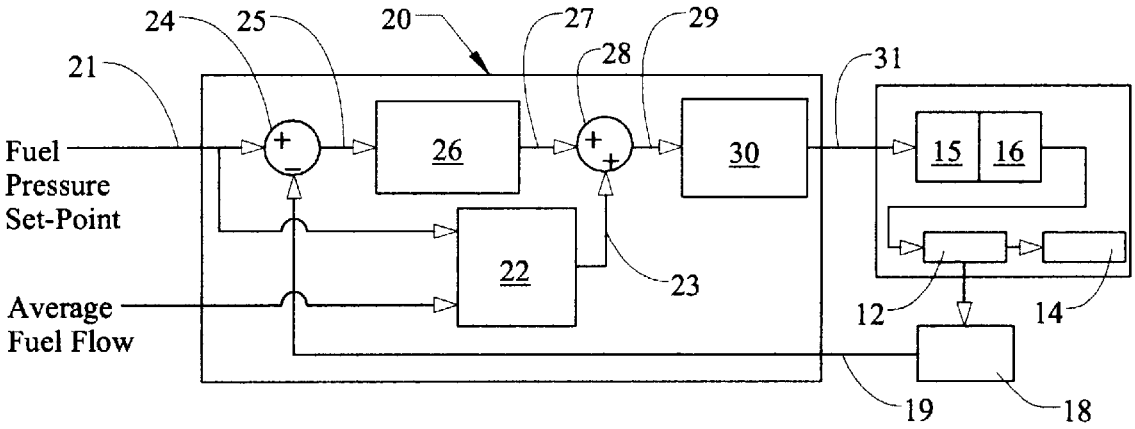
FIG. 3 is a control diagram illustrating the method of controlling the fuel delivery system of the preferred embodiment.

Referring to FIG. 3, the fuel pump motor controller 20 is a processor that is adapted to control the fuel pump 16. Mainly, the fuel pump motor controller 20 controls the speed of a motor 15 that drives the fuel pump 16. The fuel pressure sensor 18 measures the pressure within the fuel rail 12. The fuel pump motor controller 20 receives the fuel pressure and calculates the difference between a set-point pressure and the fuel rail pressure. This difference is the fuel rail pressure error signal 25 which is used to control the fuel pump speed.

The set-point pressure is the pressure at which the fuel delivery system 10 works most efficiently. In order to achieve proper fuel injection characteristics such as spray penetration and spray pattern, it is important that the fuel delivered to the fuel injector nozzles 14 remains at the appropriate pressure. This optimum pressure is the set-point pressure, and is pre-determined based upon the injector features and the specifications of the particular application. A set-point pressure signal 21 is sent to the fuel pump motor controller 20.

The fuel pump motor controller 20 calculates and outputs a motor drive signal 31 to the fuel pump motor 15. The motor drive signal 31 is calculated from the desired fuel pressure and average fuel flow demand, and attempts to drive the fuel pump motor 15 at a speed that will provide the desired fuel pressure at the desired fuel flow rate.

The fuel pump motor controller 20 includes a feed forward controller 22, a feedback controller 26, and a fuel pump motor controller driver 30. The feed forward controller 22 uses a function or algorithm, such as a look-up table with an interpolation routine, to output a feed forward control signal 23. The feed forward controller 22 inputs the set-point pressure and the average fuel flow demanded into the function or algorithm and calculates the feed forward control signal 23.

The fuel rail pressure error signal 25 is calculated by subtracting the fuel pressure sensor signal 19 from the set-point pressure signal 21. This calculation is performed by a first summing junction 24. The fuel rail pressure error signal 25 is input to the feed back controller 26. In turn, the feed back controller 26 calculates a feed back control signal 27. The feed back controller 26 can be any suitable controller, such as a Proportional Integration and Differential or model based controller.

The feed forward control signal 23 and the feed back control signal 27 are summed in a second summing junction 28, thereby generating a motor controller signal 29. The fuel pump motor controller driver 30 receives the motor controller signal 29 and generates a motor drive signal 31 that controls the speed of the fuel pump motor 15.

In a nominal fuel system with the desired fuel rail pressure at a given fuel flow rate, the feed forward control signal 23 and the motor controller signal 29 would be the same. The feed back controller 26 modifies the feed forward control signal 23 to compensate for system variations due to part to part tolerances and system aging, etc.

Figure 4:
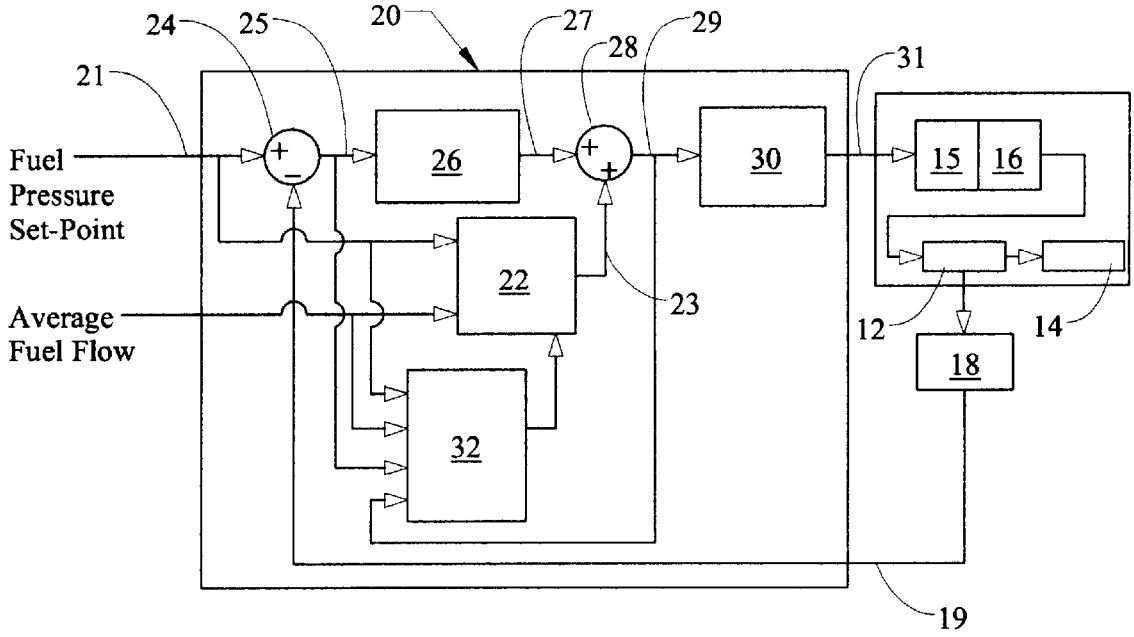
FIG. 4 is a control diagram for a variation of the first preferred embodiment.

A first preferred embodiment of the invention is shown in FIG. 3, wherein the fuel pressure sensor 18 is a relatively low bandwidth sensor that is mounted onto the fuel rail 12 to directly measure the fuel pressure therein. Referring to FIG. 4, in a variation of the first preferred embodiment, the fuel pump motor controller 20 further includes an adaptive learning controller 32 which uses an algorithm to monitor the conditions of the fuel delivery system 10 and updates the feed forward controller 22 when the system is operating in a steady state condition.

The algorithm of the adaptive learning controller 32 receives the set-point pressure signal 21, the average fuel flow, the fuel rail pressure error 25, and the motor controller signal 29 as inputs. The algorithm then compares the motor controller signal 29 to the feed forward control signal 23 corresponding to the current set-point signal and the average fuel flow within the feed forward controller 22, and updates the values within the feed forward controller 22 appropriately.

Figure 5:
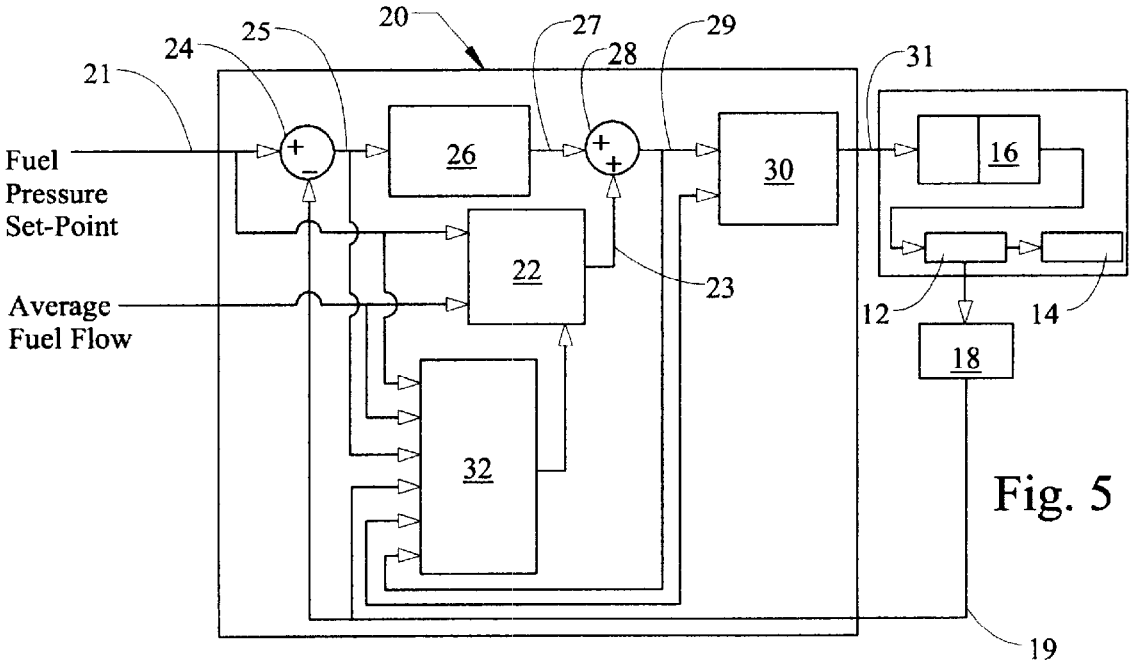
FIG. 5 is a control diagram similar to FIG. 4 wherein an adaptive learning algorithm receives additional feedback information.

The algorithm of the adaptive learning controller 32 receives the error signal 25 and the feed forward controller 22 is only updated when the error has stabilized and is below a pre-determined threshold. Referring to FIG. 5, additionally, the speed of the fuel pump 16 and the pressure from the pressure sensor 18 can also be received by the adaptive learning controller 32 to provide additional parameters for more accurate updating of the feed forward controller 22.

Figure 2:
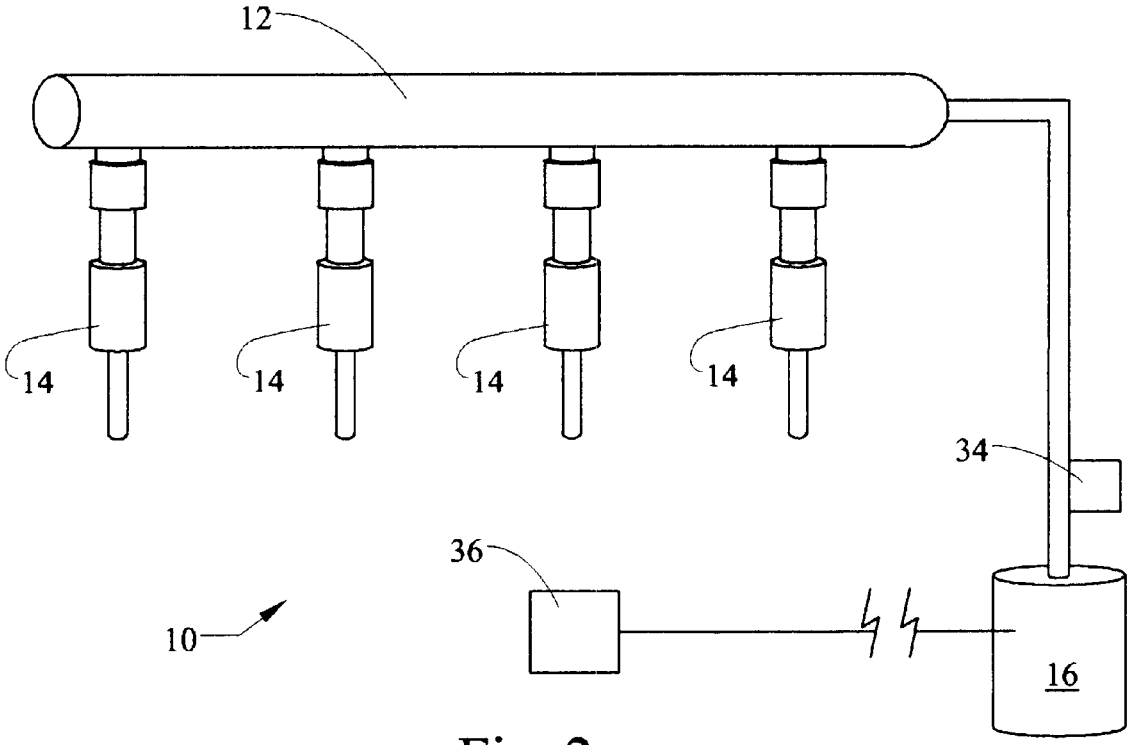
FIG. 2 is a schematic view of a second preferred embodiment of a fuel rail delivery system of the present invention.

A second preferred embodiment is shown in FIG. 2, wherein like elements are numbered the same as the first preferred embodiment. The second preferred embodiment includes a fuel pressure sensor 34 mounted at the fuel pump 16 to measure the fuel pressure within the fuel delivery system 10 at the fuel pump 16. The fuel pressure sensor 34 of the second preferred embodiment is a relatively wide bandwidth sensor.

Figure 6:
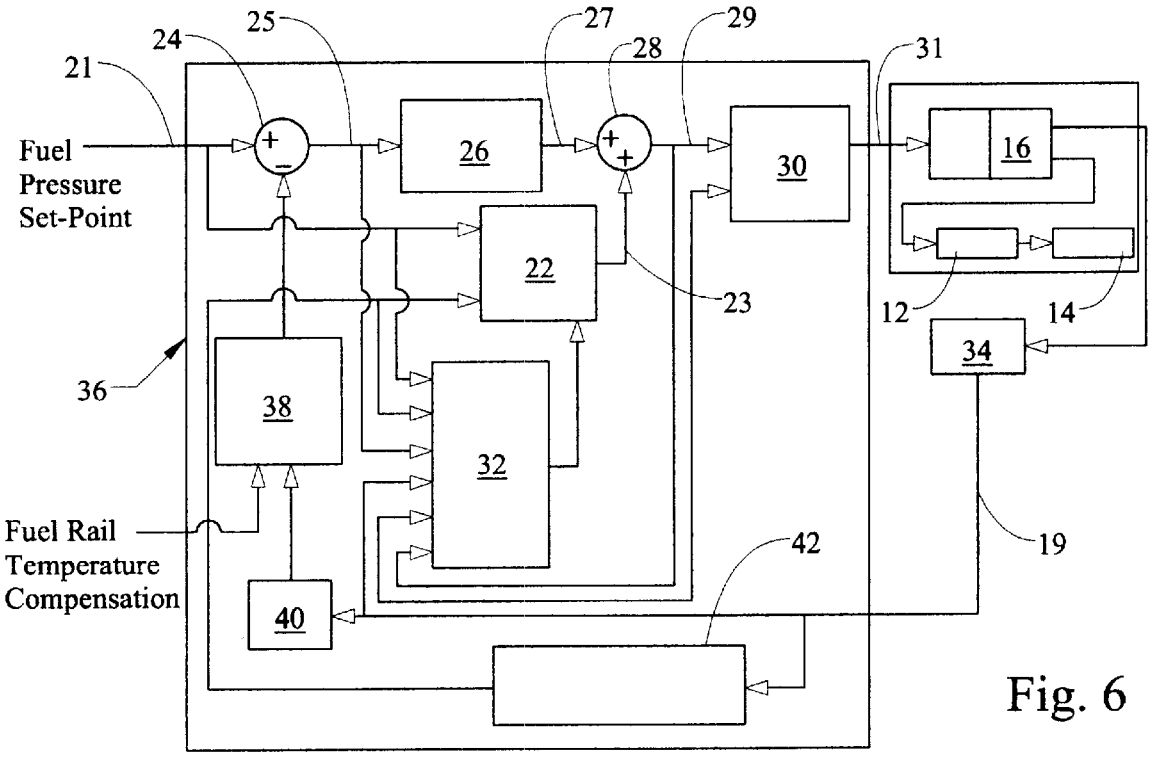
FIG. 6 is a control diagram for the second preferred embodiment.

Referring to FIG. 6, a fuel pump motor controller 36 of the second preferred embodiment is similar to the fuel pump motor controller 20 of the first preferred embodiment, however the second preferred embodiment also includes a fuel system model 38, a low-pass filter 40, and a device 42 to calculate the average fuel flow. The fuel system model 38 receives the fuel pressure as measured by the pressure sensor 34 at the fuel pump 16 and the fuel system model 38 estimates the fuel rail pressure based upon the pressure at the fuel pump 16.

The wide bandwidth pressure sensor 34 will measure both the average fuel pump outlet pressure as well as pressure pulses caused by the opening and closing of the fuel injectors 14. The low-pass filter 40 filters out pulses in the pressure readings due to the opening and closing of the fuel injectors 14, so the feed back controller 26 does not respond to these injector pulsations. The fuel system model 38 can also include input of the fuel rail 12 temperature. The temperature of the fuel rail 12 influences the fuel rail pressure estimation, so the fuel system model 38 can take this temperature into consideration to more accurately approximate the pressure within the fuel rail 12 based upon the pressure measured at the fuel pump 16. The wide band pressure from the pressure sensor 34 is also used by the device 42 to calculate the average fuel flow. From the pressure pulsations caused by the opening and closing of the injectors, the injector frequency and on-time duration can be obtained. By using this information along with the injector flow rate, the average fuel flow rate can be calculated, thereby eliminating the need for external average fuel flow information.

It is to be understood, that the processors, sensors, fuel pump, and controllers are conventional devices that are common in the industry and are described herein merely to provide examples of how the method of the present invention can be practiced.

The foregoing discussion discloses and describes two preferred embodiments. One skilled in the art will readily recognize from such discussion, and from the accompanying drawings and claims, that changes and modifications can be made to the preferred embodiments without departing from the true spirit and fair scope of the inventive concepts as defined in the following claims. The preferred embodiments have been described in an illustrative manner, and it is to be understood that the terminology which has been used is intended to be in the nature of words of description rather than of limitation.

We claim:

1. A method of controlling the fuel pressure within a fuel delivery system having a fuel pump which delivers fuel to a fuel rail of an internal combustion engine comprising:

providing a set-point fuel pressure;

providing the estimated average fuel flow through the system;

generating a feed forward control signal based upon the set-point fuel pressure and the average fuel flow;

measuring the fuel rail pressure with a fuel pressure sensor;

filtering the output of the fuel pressure sensor to filter out pulses due to the opening and closing of the fuel injectors;

comparing the fuel rail pressure to the set-point fuel pressure and generating an error signal based upon the difference between the fuel rail pressure and the set-point fuel pressure; and modifying the feed forward control signal based upon the error signal thereby generating a motor controller signal and sending the motor control signal to the fuel pump motor.

2. The method of claim 1 wherein generating a feed forward control signal includes providing a feed forward controller which provides established fuel pump motor control parameters at particular set-point pressure and average fuel flow rate values, wherein the set-point pressure and average fuel flow are input to the feed forward controller and a feed forward control signal having set of corresponding fuel pump motor control parameters is thereby generated.

3. The method of claim 1 further including:

comparing the motor control signal to the fuel pump motor control parameters within the feed forward controller which correspond to the set-point pressure and the average fuel flow; and updating the feed forward controller with new fuel pump motor control parameters.

4. The method of claim 3 further including monitoring the error signal, and updating the feed forward controller after the error signal has stabilized and is below a pre-determined level.

5. The method of claim 1 wherein measuring the fuel rail pressure includes measuring the fuel pressure at the fuel pump and estimating the fuel rail pressure based upon the fuel pressure as measured at the fuel pump.

6. The method of claim 1 further including:

detecting pulses in the signal from the fuel pressure sensor to establish when the injectors open and close;

measuring the time between when an injector opens and closes to determine how long the injector is open;

using the injector flow rate and the injector open time to calculate the average fuel flow.

7. A fuel delivery system comprising:

a fuel rail adapted to deliver fuel to fuel injectors of an automotive vehicle, a fuel pump adapted to deliver fuel to said fuel rail, a fuel pressure sensor adapted to measure the fuel rail pressure, a low-pass filter adapted to filter the output of said fuel pressure sensor to filter out pulses due to the opening and closing of the fuel injectors, and a fuel pump motor controller having:

a feed forward controller adapted to provide a feed forward signal having fuel pump motor control parameters based upon a set-point fuel pressure and the average fuel flow through said system;

a first summing junction adapted to compare the fuel rail pressure to the set-point fuel pressure and to generate an error value based upon the difference between the fuel rail pressure and the set-point fuel pressure;

a feed back controller adapted to receive the error value and to generate a feed back control signal;

a second summing junction adapted to receive the feed back control signal from said feed back controller and the feed forward control signal from the feed forward controller and to modify the fuel pump motor control parameters of the feed forward control signal based upon the feed back control signal to generate a motor controller signal; and a fuel pump motor controller driver adapted to receive the motor controller signal and to control the speed of said fuel pump based upon the motor controller signal.

8. The fuel delivery system of claim 7 wherein said fuel pressure sensor is mounted at said fuel rail to directly measure the fuel pressure within said fuel rail.

9. The fuel delivery system of claim 7 wherein said feed back controller is a proportional integration and differential closed loop controller.

10. The fuel delivery system of claim 7 further including an adaptive learning controller having an algorithm which is adapted to monitor the conditions of the fuel delivery system and to update said feed forward controller.

11. The fuel delivery system of claim 7 wherein said fuel pressure sensor is mounted at said fuel pump to measure the fuel pressure within the fuel delivery system at said fuel pump.

12. The fuel delivery system of claim 11 further including a fuel system model adapted to estimate the fuel pressure within said fuel rail based upon the fuel pressure as measured at said fuel pump.

13. A method of controlling the fuel pressure within a fuel delivery system having a fuel pump which delivers fuel to a fuel rail and fuel injectors of an internal combustion engine comprising:

providing a set-point fuel pressure;

providing the estimated average fuel flow through the system;

generating a feed forward control signal based upon the set-point fuel pressure and the average fuel flow;

measuring the fuel rail pressure with a fuel pressure sensor;

comparing the fuel rail pressure to the set-point fuel pressure and generating an error signal based upon the difference between the fuel rail pressure and the set-point fuel pressure;

modifying the feed forward control signal based upon the error signal thereby generating a motor controller signal and sending the motor control signal to the fuel pump motor;

detecting pulses in the signal from the fuel pressure sensor to establish when the fuel injectors open and close;

measuring the time between when an injector opens and closes to determine how long the injector is open;

using the injector flow rate and the injector open time to calculate the average fuel flow.

14. The method of claim 13 wherein generating a feed forward control signal includes providing a feed forward controller which provides established fuel pump motor control parameters at particular set-point pressure and average fuel flow rate values, wherein the set-point pressure and average fuel flow are input to the feed forward controller and a feed forward control signal having set of corresponding fuel pump motor control parameters is thereby generated.

15. The method of claim 13 further including:

comparing the motor control signal to the fuel pump motor control parameters within the feed forward controller which correspond to the set-point pressure and the average fuel flow; and updating the feed forward controller with new fuel pump motor control parameters.

16. The method of claim 15 further including monitoring the error signal, and updating the feed forward controller after the error signal has stabilized and is below a predetermined level.

17. The method of claim 13 wherein measuring the fuel rail pressure includes measuring the fuel pressure at the fuel pump and estimating the fuel rail pressure based upon the fuel pressure as measured at the fuel pump.

18. The method of claim 13 further including filtering the signal sent from the fuel pressure sensor to filter out pulses due to the opening and closing of the fuel injectors.

* * * * *